United States Patent [19]

McCants

[11] Patent Number: 4,883,582

[45] Date of Patent: Nov. 28, 1989

[54] VIS-BREAKING HEAVY CRUDE OILS FOR PUMPABILITY

[76] Inventor: Malcolm T. McCants, 2400 Augusta, Suite 260, Houston, Tex. 77057

[21] Appl. No.: 164,861

[22] Filed: Mar. 7, 1988

[51] Int. Cl.[4] ..... C10G 65/12; C10G 47/20

[52] U.S. Cl. ..... 208/106; 208/130; 208/48 R; 208/103; 208/107

[58] Field of Search ..... 208/106, 107, 100, 102, 208/103, 109, 78, 414, 427, 130, 48 R, 48 Q

[56] References Cited

U.S. PATENT DOCUMENTS

| | | | |
|---|---|---|---|
| 3,044,951 | 7/1962 | Schlinser et al. | 208/107 |
| 3,474,596 | 10/1969 | Scott et al. | 208/106 |
| 3,549,519 | 12/1970 | Munro et al. | 208/106 |
| 4,115,467 | 9/1978 | Fowler | 208/107 |
| 4,405,442 | 9/1983 | Daschamps et al. | 208/107 |

OTHER PUBLICATIONS

Hus, "Visbreaking Process Has Strong Revival", pp. 109–120, Technology, (Apr. 13, 1981), Oil & Gas Journal.

Allen et al., "Visbreaking High-Vacuum Residuum", pp. 78–84, Jun. 14, 1951, Oil & Gas Journal.

Sung et al., "Thermal Cracking of Petroleum", pp. 1153–1161, Industrial and Engineering Chemistry, vol. 37, No. 12, Dec. 1945.

Janssen et al., "Improved Coking Design Can Up Liquid Yields", pp. 79–83, Technology, Jun. 25, 1984, Oil & Gas Journal.

Kuo, "Effects of Crude Types on Visbreaker Conversion", pp. 100–102, Technology, Sep. 24, 1984, Oil & Gas Journal.

Gadda, "Neste Oy Gives Product Stability As Much Atention As Conversion in Visbreaking", pp. 120–122, Technology, Oct. 18, 1982, Oil & Gas Journal.

*Primary Examiner*—Glenn Caldarola

*Attorney, Agent, or Firm*—George H. Dunsmuir

[57] ABSTRACT

Crude oils are normally so viscous that they cannot be pumped through pipelines without periodic heating. The usual practice is to pump the oil from one heat station to another, with part of the crude oil being used to generate heat. This problem is solved by reducing the viscosity of the crude oil. The viscosity reduction is effected using reactors for partially cracking crude oil, mixing the partially cracked oil with incoming crude oil, separating gases from the liquid in the mixture in a flash vessel, condensing the gases to yield liquid hydrocarbons, and mixing the latter with untreated crude oil and liquid residue from the flash vessel to yield a flowable, relatively low viscosity mixture. Coke produced in the reactors is periodically reacted with superheated steam to yield hydrogen, which is used to improve the quality of some of the residue from the flash residue. The thus treated flash vessel residue is used to feed the reactors.

6 Claims, 1 Drawing Sheet

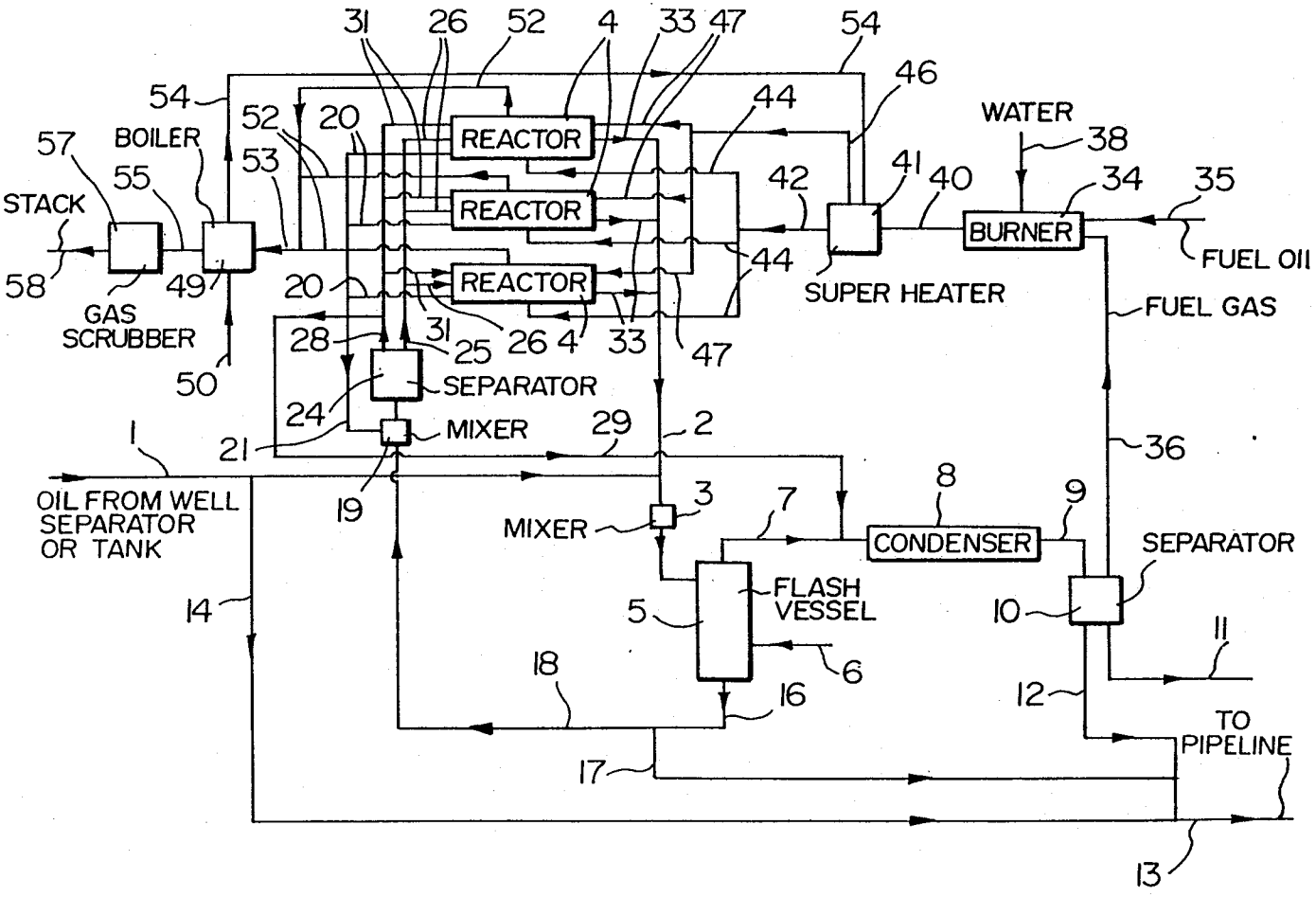
FUEL OIL
FUEL GAS
WATER
BURNER
SUPER HEATER
SEPARATOR
TO PIPELINE
CONDENSER
FLASH VESSEL
MIXER
REACTOR
REACTOR
REACTOR
SEPARATOR
MIXER
BOILER
GAS SCRUBBER
STACK
OIL FROM WELL SEPARATOR OR TANK

VIS-BREAKING HEAVY CRUDE OILS FOR PUMPABILITY

BACKGROUND

This invention relates to a method and an apparatus for treating crude oil, and in particular to a method and an apparatus for reducing the viscosity of crude oil.

An ongoing problem in the oil industry when producing heavy oils 0° to 20° API) is to lower the viscosity of oils so that they flow readily. Viscosity can be lowered in situ by many methods including steam flooding, huff and puff, in situ combustion and $CO_2$ flooding. The pipeline movement of heavy crude oils necessitates a lowering of the viscosity of the oil. Usually the oil is heated. In pipelines, the oil is pumped from one heat station to the next, with part of the crude oil being used to provide fuel for generating heat.

The object of the present invention is to offer a solution to the above-identified problem by providing a relatively simple method and apparatus for reducing the viscosity of crude oil so that the oil can readily be pumped without periodic heating.

SUMMARY OF THE INVENTION

According to one aspect the invention relates to a method of reducing the viscosity of crude oil comprising the steps of:

(a) heating the crude oil to yield partially cracked oil and a gas;

(b) mixing the partially cracked oil with untreated oil to quench cracking and produce a first mixture;

(c) separating gas and vapor from said first mixture;

(d) condensing the gas and vapor from step (c);

(e) mixing a first portion of the liquid residue from separation step (c) with untreated crude oil and liquid hydrocarbons from the condensation step (d) to yield a crude oil mixture of lower viscosity than the untreated oil, and (f) using a second portion of the liquid residue from the separation step (c) for the crude oil heating step (a).

The invention also relates to an apparatus for reducing the viscosity of crude oil comprising inlet pipe means for introducing crude oil into the apparatus; reactor means for heating the crude oil to yield partially cracked oil; first mixer means for mixing untreated crude oil with partially cracked crude oil to quench the cracking and yield a first mixture; first separator means for removing gas and vapor from the first mixture; condenser means for condensing liquid hydrocarbons from the gas and vapor; outlet pipe means for discharging a mixture from the apparatus and bypass pipe means connecting said inlet pipe means to said outlet pipe means, whereby a mixture of untreated crude oil from said bypass pipe means, liquid residue from said first separator means and liquid hydrocarbons from said condenser means can be produced, said mixture having a viscosity lower than that of the crude oil.

Thermal cracking or vis-breaking of oil is one of the oldest processes in the petroleum industry and is used to produce lighter products from heavy crude oil. The refining of crude oil using vis-breaking is normally accompanied by extreme measures to prevent the deposition of coke in heaters or other equipment. The invention described herein uses the coke for generating hydrogen, which is used to improve the quality of the product.

BRIEF DESCRIPTION OF THE DRAWINGS

The invention will be described in greater detail with reference to the accompanying drawing, the single FIGURE of which is a schematic flow diagram of an apparatus in accordance with the invention.

DESCRIPTION OF THE PREFERRED EMBODIMENTS

With reference to the drawing, the apparatus of the present invention includes an inlet line 1 for introducing untreated crude oil into the apparatus. (In this specification and the appended claims, the word "untreated" is intended to mean not treated in the apparatus or using the process of the present invention.) The oil is any high viscosity and/or high pour point crude oil or other type of hydrocarbon. Usually the oil will be crude oil from a production tank or pit and has been de-sanded and dewatered in an oil field separator. Oil introduced through the line 1 flows into a second line 2 and a mixer 3 for mixing with Partially cracked oil from tube-type reactors 4, and for achieving thermal equilibrium in the mixture. The oil mixture thus produced is injected into a flash vessel 5 where gas and vapor are removed from the oil. In order to control the flash temperature in the vessel 5, the mixture in the line 1 can be preheated. Steam is introduced into the vessel 5 via line 6 for stripping light hydrocarbons dissolved in the liquid.

The gas and vapor are discharged through an outlet duct 7 to a condenser 8, and liquid hydrocarbons and gas from the latter are fed through a line 9 to a separator 10. Water is separated from the liquid hydrocarbons and discharged through outlet 11, and the hydrocarbons flow through an outlet pipe 12 for blending with other ingredients in a line 13 flowing into a pipeline (not shown). Some of the untreated crude oil entering the system through the line 1 flows through a bypass 14 for mixing with the ingredients in the line 13.

The gas and vapors discharged through outlet duct 7 may be to a fractionation system (not shown) for the production of diesel fuel and gas oil for use in engines and boiler fuel in the field.

The liquid mixture remaining in the flash vessel 5 is discharged through a line 16. A portion of such mixture is diverted through pipe 17 for mixing with the liquid in the line 13. The remainder of the mixture is fed through a line 18 to a static mixer 19. The liquid entering the mixer 19 is mixed with regenerated gases which are discharged from the reactors 4 through lines 20 and 21 to the mixer 19. The gas stream contains hydrogen from the reaction of steam with coke in the reactors 4. The static mixer 19 ensures good contact between the hydrogen and the liquid.

The mixture leaving the mixer is fed into a cyclone separator 24 for separation of gas and liquid. The liquid is fed into the reactors 4 via lines 25 and 26, and the gas is discharged through pipe 28. The bulk of the gas in the pipe 28 passes through a line 29 to the duct 7 for mixing with the gas and vapor flowing into the condenser 8. Some of the gas is fed through the pipe 28 and tubes 31 into the reactors 4 for controlling the velocity of heating liquids in the reactor tubes (not shown).

The liquid residue discharged from the separator 24 is fed into the reactor 4 where the liquid is partially cracked. In the reactors 4, liquid is heated to a temperature of 700° to 1000° F. (at a pressure of 100 to 300 psig)

depending upon the type of residue. Maximum vis-breaking is achieved by proper coke deposition. Each liquid fraction from the separator 24 has its own optimum cracking conditions. Liquids with a paraffinic characterization factor of approximately 12 are more easy to crack thermally with less coke formation than liquids with a characterization factor of 11 or 10. Liquids (aromatic) with a characterization factor of 10 yield more coke than oils with characterization factors of 11 or 12. Since the rate of reaction between superheated steam and coke deposited in the reactors 4 is the controlling time factor, the number of reactors 4 is dictated by the characterization factor of the liquid from the separator 24 as follows:

| Characterization Factor | Number of Reactors |
|---|---|
| 12 | 2 |
| 11 | 3 |
| 10 | 4 |

Oil treated in the reactors 4 is discharged via lines 33 to the line 2 and the mixer 3 where partially cracked oil is mixed with untreated oil.

Heat for thermal cracking or vis-breaking of the oil in the reactors 4 is produced in a burner 34. Fuel for the burner 34 is introduced from a source of fuel (not shown) via line 35 and through line 36 from the separator 10. The noncondensible gases from the separator 10 contain light hydrocarbons from the cracking step, unreacted hydrogen and carbon monoxide, etc. All of these gases are burned in the burner 34. The fuel oil introduced through the line 35 is used as a supplemental fuel and for starting the burner 34. Water introduced through a line 38 can be used to quench the burner 34. Flue gases from the burner 34 pass through a pipe 40, a superheater 41 and lines 42 and 44 to the reactors 4.

Hydrogen may be added to the thermally cracking residue in the reactors 4 for addition to the newly created olefins. The hydrogen is added in the form of methanol and/or ammonia. Both compounds decompose under reactor conditions to liberate hydrogen, which reacts with free radicals to improve the quality of the liquid product.

An example of the expected yields from a reactor operating at an outlet temperature of 800° F. follows:

EXAMPLE

| | Characterization Factor | | |
|---|---|---|---|
| | 12 | 11 | 10 |
| Carbon deposition (wt %) | 4.5 | 6.5 | 9.6 |
| HC Gas (wt %) | 13 | 7 | 2 |
| Light HC (wt %) | 7 | 8 | 11 |
| Gas Oil (wt %) | 42 | 36 | 24 |
| Residue (wt %) | 33.5 | 42.5 | 53.4 |
| | 100 | 100 | 100 |

Steam from the superheater 41 is introduced periodically into the reactors 4 via lines 46 and 47. For such purpose, suitable valves (not shown) are provided in the lines 20, 25, 26, 28, 31, 33, 42, 44, 46 and 47. Thus, the reactors 4 can be switched from vis-breaking to regeneration, in which superheated steam is used to remove coke deposits. In order to react with the carbon deposits in the reactors 4, the temperature of the superheated steam is 1,000° to 1,200° F. Water is introduced into a boiler 49 through a line 50 for generating steam. The boiler is heated using flue gases from the reactors 4. The gases are fed to the boiler 49 through lines 52 and 53. Steam is fed from the boiler 49 through a pipe 54 to the superheater 41. Flue gas is discharged from the boiler 49 through a pipe 55 and a gas scrubber 57 to a stack 58 for venting to the atmosphere. The scrubber 57 is necessary only if the sulfur dioxide content of the gas is higher than permissible levels.

The superheater 41 increases the temperature of the dry, saturated steam from the boiler 49 to 1,000°-1,200° F. The rates of reaction between coke and steam are thoroughly documented in "Chemical Equilibria in Carbon-Hydrogen-Oxygen Systems" by Baron, Porter and Hammond, The MIT Press.

If the burner 34 is operated under pressure, clean flue gas can be used in an expander turbine (not shown) to generate electricity or for other purposes. Excess gas from the separator 10 can be used in a gas turbine, and hot gases from the turbine can be fed to the boiler 49 for heat recovery. By the same token, excess steam from the boiler 49 can be used in a steam turbine to generate electricity.

While operation of the apparatus should be obvious from the foregoing, a summary of the manner of using the system is deemed to be worthwhile. In operation, heavy, viscous crude oil is pumped from production tanks, heated separators or wells through the line 1. The incoming crude oil may be preheated to control the temperature of the mixture of reactor effluent and crude oil entering the flash vessel 5. The temperature is sufficiently high to flash off all of the low boiling constituents in the crude oil/reactor effluent mixture.

Untreated crude oil is used as a quench to stop additional cracking of the reactor effluent. Some stripping steam is used to strip distillates still dissolved in the flash vessel residue, i.e. liquid being discharged from the vessel 5.

The partially cracked and straight run residue from the flash operation are contacted with gases including hydrogen or carbon monoxide and steam from the reactor regeneration cycle. Mixing of the gases and oil is effected in static mixers to ensure the maximum contact between cracked oil and hydrogen, whereby non-catalytic hydrogenation occurs. The resulting two phase flow enters the cyclone separator 24 for separation of the gases from the liquid. The liquid is heated in the reactors 4 to promote cracking, and then discharged through the line 2 where incoming crude oil is the quench to stop the cracking reaction.

The mixture ultimately fed to the pipeline via line 13 includes untreated oil, partially cracked crude oil and liquids condensed from the gases and vapor discharegd from the flash vessel 5 and the separator 10. The mixture is relatively low in viscosity and pour point, and consequently easy to pump. The mixture does not require heating in the pipeline, tanker or other carrier.

What I claim is:

1. A method of reducing the viscosity of untreated crude oil, comprising the steps of:

(a) vis-breaking in a reactor a first portion of the untreated crude oil with a recycled stream to produce a partially cracked residuum of the untreated oil;

(b) mixing the partially cracked residuum of the untreated oil with a second portion of the untreated oil to quench cracking and producing a first mixture;

(c) separating gas, vapor, and liquid by flashing from said mixture;

(d) condensing the gas and vapor obtained in step (c) to produce liquid hydrocarbons and gas;

(e) splitting the liquid obtained in step (c) into first and second streams thereof;

(f) passing said first stream obtained in step (e) for use as said recycled stream in step (a);

(g) reacting coke produced in step (a) with superheated steam to produce a hydrogen-containing gas during regeneration cycle to the reactor; and (h) mixing said hydrogen-containing gas with said first stream obtained in step (e) prior to vis-breaking in step (a).

2. A method according to claim 1, and including the step of:

(i) mixing said second stream obtained in step (e) with a third portion of the untreated oil and the liquid hydrocarbons obtained in step (d).

3. A method according to claim 1, including the step of:

(j) burning the gas obtained in step (d) to generate heat for the reactor.

4. A method according to claim 3, including the steps of:

(k) mixing a fuel with the gas obtained in step (d); and (l) burning the mixture obtained in step (k) to generate heat for the reactor.

5. A method according to claim 1, including the step of:

(m) producing superheatod steam for use in step (g) by heating water from burning flue gases generated in the reactor.

6. A method according to claim 1, including the steps of:

(n) separating gases and liquid from the mixture obtained in step (h);

(o) passing the liquid obtained in step (n) for vis-breaking in step (a); and (p) mixing the gases obtained in step (n) with the gas and vapor obtained in step (c) for condensing in step (d).

* * * * *